United States Patent [19]

Adcock

[11] 4,295,393

[45] Oct. 20, 1981

[54] STUD HANDLING TOOL

[75] Inventor: Marty E. Adcock, Logan, Ohio

[73] Assignee: The Babcock & Wilcox Company, New Orleans, La.

[21] Appl. No.: 115,519

[22] Filed: Jan. 25, 1980

[51] Int. Cl.[3] ..... B25B 29/00

[52] U.S. Cl. ..... 81/57.4; 81/57.24; 81/57.35; 81/57.38

[58] Field of Search ..... 81/57.11, 57.12, 57.13, 81/57.14, 57.24, 57.34, 57.35, 57.38, 57.4

[56] References Cited

U.S. PATENT DOCUMENTS 3,288,000 11/1966 Foster ..... 81/57.34

3,505,913 4/1970 Dickmann et al. ..... 81/57.35

*Primary Examiner*—James L. Jones, Jr.

*Attorney, Agent, or Firm*—James A. Hudak; Vytas R. Matas; Robert J. Edwards

[57] ABSTRACT

A tool (10) for inserting large studs (80) into and removing them from nuclear reactor pressure vessel closures and the like. The tool includes an air motor and gear reducer assembly (16) for rotating the stud (80), and an air cylinder assembly (14) for applying a predetermined upward preload to the stud (80) to prevent the weight of the stud (80) from binding the threads thereof. Regulator means (130) is provided for maintaining the preload constant as the stud (80) is threaded into or out of the closure.

9 Claims, 4 Drawing Figures

STUD HANDLING TOOL

TECHNICAL FIELD

The present invention relates generally to tools for inserting and removing large fastening devices and more particularly to a tool for inserting and removing heavy studs used on large bolted closures, such as covers for pressure vessels and the like.

BACKGROUND ART

Tools for inserting and removing heavy studs used to fasten the cover on nuclear reactor pressure vessels must be capable of handling stud assemblies weighing up to 1000 lbs. Because of the weight of these studs, the stud threads have a tendency to bind unless an upward preload is applied to the stud during the removing and inserting operation. Most prior art tools use sets of springs to apply this preload and rotate the stud with a leadscrew and nut arrangement. In this approach the leadscrew and nut arrangement must have the same thread pitch as the stud in order to maintain a constant preload for the full travel of the stud as it is threaded into or out of the pressure vessel cover flange. Thus, these tools are limited to use on studs having the same pitch unless the leadscrew assembly is changed. These prior art tools are also inherently slow to operate since the leadscrew nut must be threaded back to the opposite end of its travel to position it for the next stud. And lastly, the size and number of springs required varies with the size of the stud, thus requiring a time consuming change of springs, or the use of different tool for each stud size.

Because of the inherent problems associated with the use of the prior art tools for inserting and removing heavy studs, it has become desirable to develop a tool that can be used on any number of different sizes of studs and which will apply an upward preload to the stud in order to prevent the threads formed thereon from binding in the threaded bore into which the stud is inserted and removed.

SUMMARY OF THE INVENTION

The present invention solves the aforementioned problems associated with the prior art as well as other problems by providing a stud handling tool that applies a predetermined upward preload to the stud when being inserted into or removed from a threaded bore, such as those provided in a nuclear reactor pressure vessel cover flange, in order to prevent the threads provided on the stud from binding with the threads provided within the threaded bore. This is accomplished by including within the stud handling tool an air cylinder operable to apply a linear force to the stud, and a rotary air motor and gear reducer assembly operable to apply a torque to the stud in order to thread it into or out of the threaded bore. The tool is adapted to be suspended from a hoist above the threaded bore and includes manual means for positioning the tool precisely above the threaded bore into which the stud is to be inserted or removed therefrom. The tool further includes regulator means for maintaining a constant upward axial force on the stud to which it is applied.

In view of the foregoing, it will be seen that one aspect of the present invention is to provide a stud handling tool which is operated by compressed air, and which includes infinitely variable means for applying an upward biasing force to a heavy stud, and for threading a stud into and out of a threaded receptable, such as a nuclear reactor pressure vessel cover flange.

Another aspect of the present invention is to provide a stud handling tool which can be applied to studs of various size and various thread pitches without the need for making major changes of tool components and accessories.

These and other aspects of the present invention will be more clearly understood after a review of the following description of the preferred embodiment when considered with the drawings.

DETAILED DESCRIPTION OF THE PREFERRED EMBODIMENT

Figure 1:
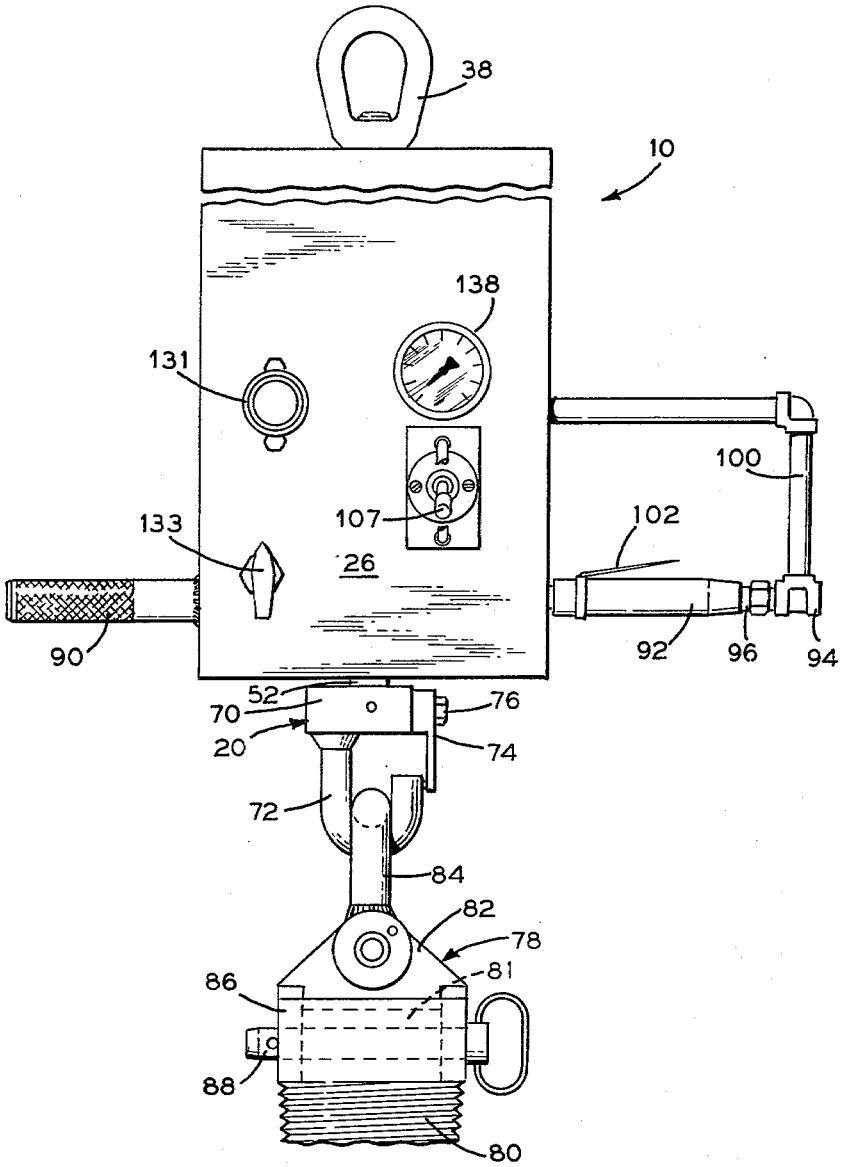
FIG. 1 is a front elevation view of a tool constructed in accordance with the present invention.
Figure 3:
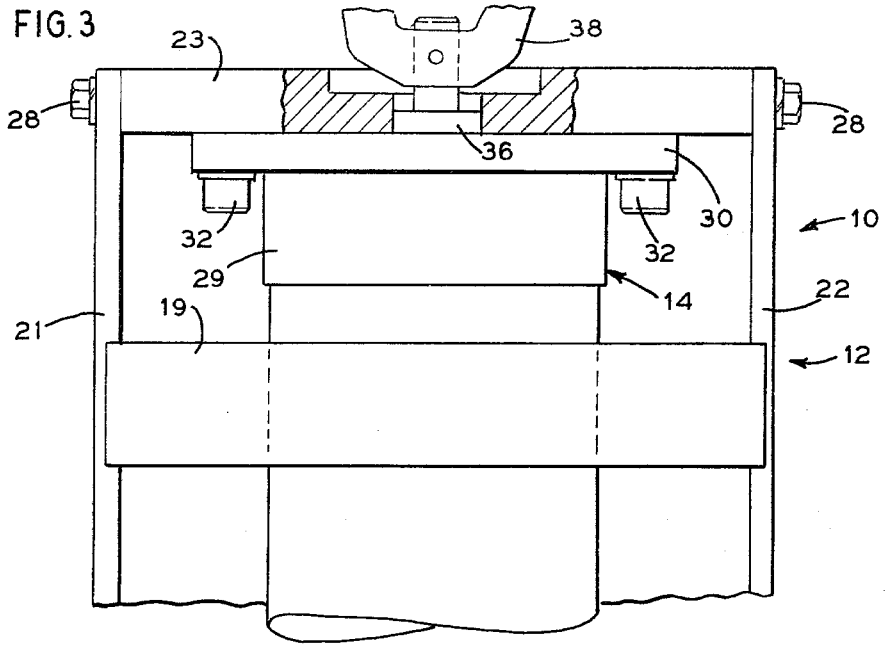
FIG. 3 is a partial rear elevation view of the upper end of the tool shown in FIG. 1 with components thereof shown in cross-section and with parts removed for clarity.
Figure 2:
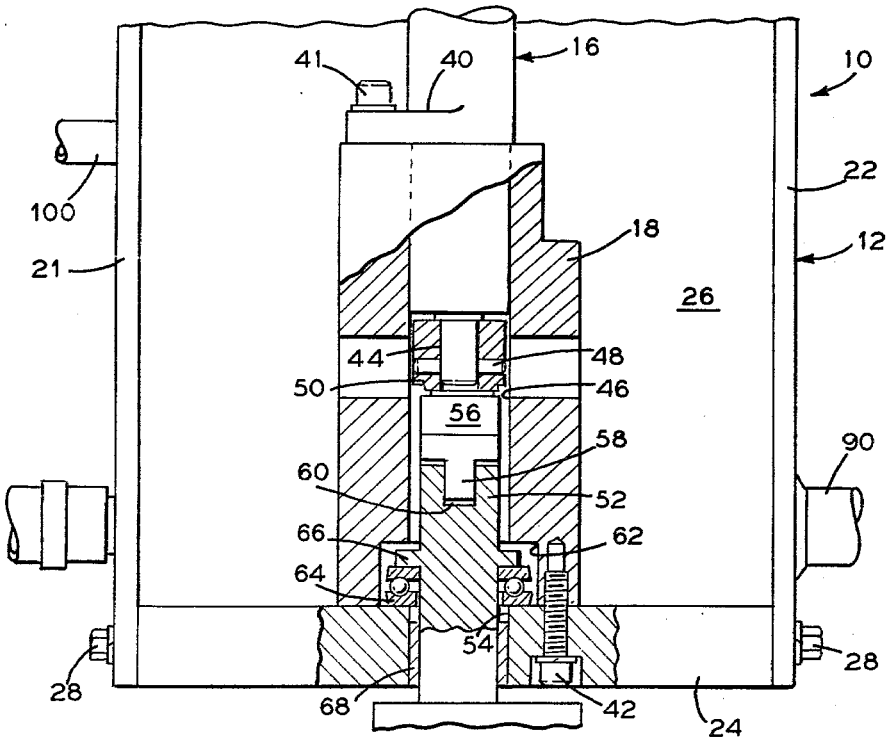
FIG. 2 is a partial rear elevation view of the lower end of the tool shown in FIG. 1 with components thereof shown in cross-section and with parts removed for clarity.

Referring now to the drawings where the illustrations are for the purpose of describing the preferred embodiment of the invention and are not intended to limit the invention hereto, FIG. 1 illustrates the exterior of the stud handling tool designated generally by the numeral 10. As illustrated in FIGS. 2 and 3, the stud handling tool 10 is comprised of a frame 12, an air cylinder assembly 14 received within and attached to the frame 12, a rotary air motor and gear reducer assembly 16 received within the frame 12 and attached thereto through a cylindrical spacer 18, and a stud-receiving hook assembly 20, shown in FIG. 1, operatively attached to the output of the rotary air motor and gear reducer assembly 16.

As shown in FIGS. 2 and 3, the frame 12 comprises first and second rectangular side plates 21 and 22, one or more transverse stringers 19 welded to the side plates, an upper end plate 23, a lower end plate 24, a front cover plate 26, and a rear cover plate (not shown). The end plates 23, 24 can be bolted to the side plates 21 and 22 by bolts 28, and the front and rear cover plates can be bolted or otherwise fastened to the side plates 21 and 22.

Figure 4:
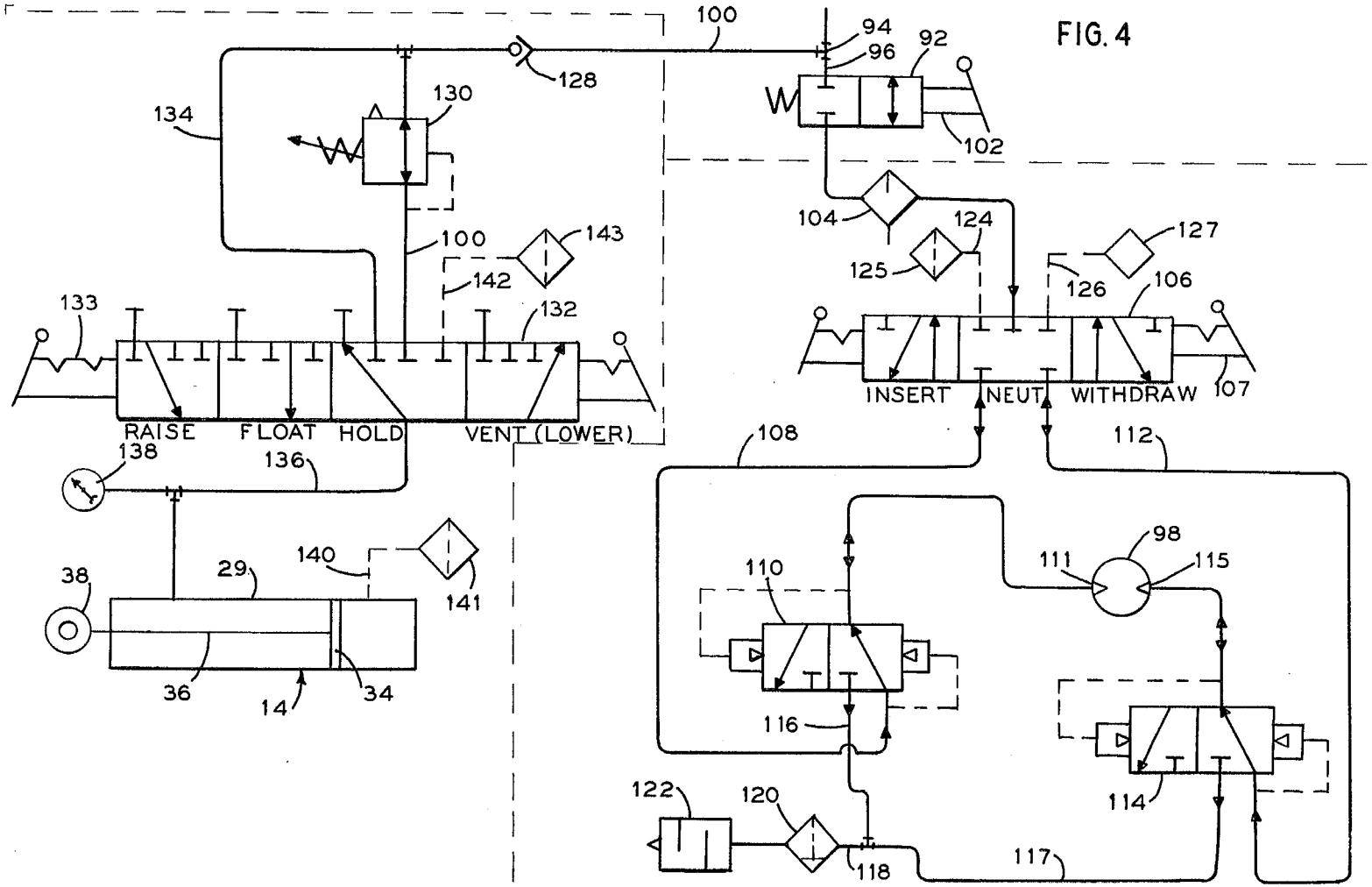
FIG. 4 is a schematic diagram for the control circuit for the tool.

Referring to FIGS. 3 and 4, the air cylinder assembly 14 is received within the frame 12 and includes a cylinder body 29, a flange 30 welded to the body 29 and attached to the upper end plate 23 by bolts 32, a piston 34, and a piston rod 36 attached to the piston 34 and protruding upwardly through a hole provided in the upper end plate 23. A lifting eye 38 is pinned on or otherwise fastened to the free end of the piston rod 36 and is adapted to be received by the load hook of a hoist.

The air motor and gear reducer assembly 16, which is of well-known conventional design and will not be described herein in detail, includes a frame 40 fastened by one or more bolts 41 to the spacer 18, as shown in FIG. 2. The opposite end of the spacer 18 is bolted to the lower end plate 24 by means of a plurality of bolts 42

(one of four shown) received through the lower end plate 24 and threaded into the end of the spacer 18.

The output shaft 44 of the air motor and gear reducer assembly 16 extends downwardly within a first inside diameter 46 in the spacer 18 where it is pinned at 48 to a coupling member 50. A coupling shaft 52 extends through an aperture 54 formed in the lower end plate 24 and is joined to the coupling member 50 by means of across-shaped key member 56 which includes a first blade 58 received within a slot 60 formed in the upper end of the coupling shaft 52 and a similar second blade (not shown) received within a slot (not shown) formed in the lower end of the coupling member 50. This arrangement permits the key member 56 to float between the coupling member 50 and the coupling shaft 52.

The lower end of the spacer 18 has an enlarged inside diameter 62 which clears a thrust bearing 64 received between the lower end plate 24 and a flange section 66 formed on the coupling shaft 52. A sleeve bearing 68 is press fit into the aperture 54 and receives the lower end of the coupling shaft 52.

The stud-receiving hook assembly 20 includes a shank portion 70 which is pinned to the lower end of the coupling shaft 52, a hook portion 72 welded to the shank 70, and a safety latch 74 attached to the shank 70 by a bolt 76, as shown in FIG. 1. The hook assembly 20 is adapted to receive a clevis assembly 78 which is used to engage a stud 80 to be threaded into or out of a vessel closure. The clevis assembly 78, which forms no part of the present invention, includes a clevis member 82, a U-shaped pivot hook 84 welded to the clevis member 82, and a cylindrical stud engaging member 86 pivotally attached to the clevis member 82. A typical stud 80 includes a reduced diameter head portion 81 which is received within the stud engaging member 86 and held therein by means of a lock pin 88 which extends through the member 86 and the stud.

To facilitate manual positioning of the tool 10, a handle 90 is attached to the side plate 22 and a hand-engageable throttle valve 92 is attached to the side plate 21 opposite the handle 90. This arrangement permits the tool to be precisely positioned over a vessel closure by grasping the handle 90 with one hand and the throttle valve 92 with the other.

Referring now to FIG. 4, air from a source (not shown) capable of supplying 50 CFM at 100 psi is supplied to the tool 10 through an inlet tee connection 94 at the inlet of the throttle valve 92, branching off via a line 96 through the throttle valve to the air motor portion 98 of the air motor and gear reducer 16, and via a line 100 to the air cylinder assembly 14.

Line 96 extends through the throttle valve 92, which includes an actuating handle 102, through a lubricator 104 to a three position air motor control valve 106 which includes a manual actuator 107 extending through the front cover plate 26. A first outlet line 108 extends from the valve 106, through a first dump valve 110 to a first inlet 111 to the air motor 98. A second outlet line 112 extends from the valve 106, through a second dump valve 114 to a second inlet 115 to the air motor 98. First and second exhaust lines 116 and 117 extend from the first and second dump valves 110, 114, respectively to a common exhaust line 118 through a filter 120 and a muffler 122 to atmosphere. Dump valves 110, 114 serve to automatically exhaust one side of the air motor 98 while the other side is pressurized. The valve 106 also includes a first breather vent line 124 extending from the valve to atmosphere through a breather 125, and a second breather vent line 126 extending from the valve to atmosphere through a breather 127.

Line 100 extends through a check valve 128, and a pressure regulator 130 to a four position air cylinder control valve 132, which includes an actuator 133 extending through the front cover plate 26. The regulator 130 also includes a manual control knob 131, shown on FIG. 1, extending through the cover plate 26. A line 134 branches off of line 100 and connects directly to the valve 132, bypassing the regulator 130. A line 136 connects the valve 132 with the rod end of the air cylinder 14. A pressure gauge 138 is mounted on the cover plate 26 and connects into line 136. The head end of the air cylinder 14 is vented to atmosphere via a line 140 and a breather 141, and the valve 132 is vented to atmosphere via a line 142 and a breather 143.

OPERATION

STUD INSTALLATION

To insert a stud, the tool 10 is suspended from a suitable hoist by means of the lifting eye 38, and an air supply line is connected to the tee 94. When this is occurring, the air cylinder control valve 132 should be in the "float" position, as indicated by the actuator 133, allowing the rod end of cylinder 14 to be pressurized via line 136. The regulator 130 is then adjusted by means of the knob 131 to obtain the desired biasing pressure for the stud to be installed.

The valve 132 is then shifted to its "raise" position, which bypasses the regulator 130 via line 134 to apply full line pressure to the cylinder 14 until the piston rod 36 is fully retracted. Using the hoist, the tool 10 is then centered over a stud 80 and lowered until the clevis assembly 78 is about one inch above the top of the stud.

The valve 32 is then shifted to its "vent" or "lower" position, which vents the rod end of the cylinder 14 to atmosphere via line 142 and breather 143 and allows the tool 10 to lower as the piston rod 36 extends, until the stud engaging member 86 of the clevis assembly 78 comes down over the reduced diameter portion 81 of the stud, which is temporarily supported in the upright position. The valve 132 is then shifted to the "hold" position, blocking all air flow therethrough, and the lock pin 88 is inserted through the member 86 and the stud 80 to lock the stud to the tool.

The valve 132 is then again shifted to its "raise" position to pressurize the cylinder 14 and raise the stud off its temporary support. The valve 132 is then shifted to its "float" position to pressurize the cylinder 14 at the predetermined pressure set by the regulator 130.

The air motor control valve 106 is then placed in its "insert" position, opening a flow path through the valve 106 to the inlet 111 of the air motor 98 via line 108 and first dump valve 110. The actuating handle 102 of the throttle valve 92 is then depressed, causing valve 92, as shown in FIG. 4, to shift to the left, allowing air to be applied to the air motor 98 and energizing the air motor in its insert direction. Using the throttle valve body 92 and the handle 90, the tool 10 is pulled downwardly until the threads of the stud 80 engage the threads of the vessel flange to which it is being applied. Once the stud threads have engaged the vessel flange threads, no further downward external force is needed. As the air motor 98 rotates the stud to thread it into the vessel flange, the air cylinder 14 maintains a constant upward force on the stud, as controlled by the regulator 130, to keep the weight of the stud from binding the threads.

Once the stud is fully engaged, the actuating handle 102 of the throttle valve 92 is disengaged to cut off the air supply to the air motor 98. To disengage the tool from the stud, the valve 132 is shifted to the "vent" position, relieving the pressure from the rod end of the cylinder 14, allowing the tool to move downward sufficiently to relieve the force applied to the stud through the clevis assembly 78. The valve 132 is then shifted to the "hold" position while the lock pin 88 is removed, after which the valve 132 is shifted to the "raise" position to fully retract the piston rod 36, and the tool 10 is moved to the next stud to be inserted.

STUD REMOVAL

Stud removal is essentially the reverse of stud installation. To prepare the tool 10 for stud removal, the valve 132 is first shifted to the "float" position and the regulator 130 is adjusted to obtain a predetermined biasing pressure for the stud to be withdrawn.

The valve 132 is then shifted to the "vent" position to relieve the pressure at the rod end of the cylinder 14, allowing the piston rod 36 to fully extend. The tool 10 is then lowered over the stud permitting the stud to be engaged by the clevis assembly 78, and the lock pin 88 is inserted through the stud engaging member 86 and the reduced diameter portion 81 of the stud 80.

The valve 132 is then returned to the "float" position to pressurize the cylinder 14 to the predetermined upward biasing pressure. The air motor control valve 106 is then shifted to the "withdraw" position and the actuating handle 102 of the throttle valve 92 is depressed, causing valve 92 to shift to the left allowing air to be applied to the air motor 98 in the withdraw direction, thus rotating the stud to thread it out of the vessel flange.

When the last thread comes out of engagement with the pressure vessel cover flange, the stud will "pop" up slightly due to the pressurization of the air cylinder 14 in the "float" position of the valve 132, after which the tool 10 will move slowly upward until the piston rod 36 is fully retracted. The valve 132 can then be shifted to the "vent" position to enable the stud to be lowered onto a support (not shown).

Once the stud is supported, the valve is shifted to the "hold" position while the lock pin 88 is removed, after which the valve 132 is moved to the "raise" position to allow the tool 10 to travel upward clear of the stud. The valve 132 can then be shifted to the "hold" position while the tool 10 is moved into position to engage another stud.

Certain modifications and improvements will occur to those skilled in the art upon reading the foregoing description. It will be understood that all such improvements and modifications have been deleted herein for the sake of conciseness and readability but are properly within the scope of the following claims.

I claim:

1. An apparatus for threadingly engaging a first threaded member with a second threaded receiving member and disengaging it therefrom, comprising a frame, means extending from said frame for suspending said first threaded member above said second threaded receiving member, a rotary air motor attached to said frame, engagement means attached to the output of said rotary air motor for engaging said first threaded member for rotation by said rotary air motor, and means attached to said frame operable to apply a lifting force to said first threaded member while said first threaded member is rotated by said air motor and in threaded engagement with said second threaded receiving member, said lifting force applying means comprising a linear air motor operably attached to said frame, and said means extending from said frame being defined by an extensible output member of said linear air motor.

2. The apparatus as defined in claim 1, wherein said linear air motor comprises an air cylinder having a body portion attached to said frame and a piston rod defining said extensible output member.

3. The apparatus as defined in claim 1, including control means operatively associated with said rotary air motor and with said linear air motor, said control means including regulator means maintaining said lifting force substantially constant for any angular position of said first threaded member relative to said second threaded receiving member.

4. The apparatus as defined in claim 3, wherein said control means includes multiple position valve means; conduit means connecting said regulator means with a source of pressurized air, said regulator means with said valve means, and said valve means with said linear air motor; and bypass conduit means connecting said valve means with said source of pressurized air bypassing said regulator means.

5. The apparatus as defined in claim 4 wherein said multiple position valve means comprises a manually operable valve having a first position wherein said linear air motor is vented to atmosphere, a second position wherein air from said pressurized air source is blocked from passage to said linear air motor, a third position wherein said linear air motor is connected to said pressurized air source through said regulator means, and a fourth position wherein said linear air motor is connected to said pressurized air source through said bypass conduit means.

6. The apparatus as defined in claim 5, wherein said multiple position valve means includes manually operable actuator means mounted on said frame for selecting said first, second, third and fourth positions.

7. The apparatus as defined in claim 3, wherein said regulator means includes manually operable means mounted on said frame for selecting a set pressure maintained by said regulator means.

8. The apparatus as defined in claim 5, including first valve means for controlling air from said pressurized air source to said rotary air motor, said first valve means including manually operable means mounted on said frame for selecting the direction of rotation of said rotary air motor.

9. The apparatus as defined in claim 8, including second valve means fluidically in series with said first valve means for controlling air from said pressurized air sources to said rotary air motor, said second valve means including a body portion mounted on said frame and manually actuatable means mounted on said body portion for controlling the volume of air directed to said rotary air motor.

* * * * *